United States Patent [19]

Montoya et al.

[11] Patent Number: 4,942,888

[45] Date of Patent: Jul. 24, 1990

[54] CIGARETTE

[75] Inventors: Maria T. Montoya, High Point; Alan B. Norman, Clemmons; Norman C. Sanders, Jr., Winston-Salem; Glenn E. Creamer, Pfafftown, all of N.C.

[73] Assignee: R. J. Reynolds Tobacco Company, Winston-Salem, N.C.

[21] Appl. No.: 298,539

[22] Filed: Jan. 18, 1989

[51] Int. Cl.[5] ..... A24D 1/02; A04D 1/18

[52] U.S. Cl. ..... 131/359; 131/352; 131/369; 131/365

[58] Field of Search ..... 131/359, 369, 365, 361, 131/336, 352

[56] References Cited

U.S. PATENT DOCUMENTS

| | | | |
|---|---|---|---|
| 2,907,686 | 10/1959 | Siegel . | |
| 3,478,751 | 11/1969 | Briskin et al. | 131/359 |
| 3,511,247 | 5/1970 | Tamol . | |
| 3,526,904 | 9/1970 | Tamol . | |
| 3,608,560 | 9/1971 | Briskin . | |
| 3,699,973 | 10/1972 | Tamol et al. . | |
| 3,705,588 | 12/1972 | Tamol et al. . | |
| 3,738,374 | 6/1973 | Bennett . | |
| 3,744,496 | 7/1973 | McCarty et al. . | |
| 3,805,799 | 4/1974 | Stewart, Jr. et al. . | |
| 3,834,398 | 9/1974 | Briskin et al. . | |
| 3,861,401 | 1/1975 | Briskin et al. . | |
| 3,885,574 | 5/1975 | Borthwick et al. . | |
| 3,911,932 | 10/1975 | Houck, Jr. et al. . | |
| 3,924,644 | 12/1975 | Anderson et al. . | |
| 3,943,941 | 3/1976 | Boyd et al. . | |
| 3,943,942 | 3/1976 | Anderson et al. . | |
| 3,965,911 | 6/1976 | Anderson et al. . | |
| 3,993,082 | 11/1976 | Martin et al. . | |
| 4,014,349 | 3/1977 | Morman et al. . | |
| 4,019,520 | 4/1977 | Strubel et al. | 131/359 |
| 4,019,521 | 4/1977 | Briskin . | |
| 4,044,777 | 8/1977 | Boyd et al. . | |
| 4,077,414 | 3/1978 | Baker et al. . | |
| 4,079,742 | 3/1978 | Rainer et al. . | |
| 4,108,151 | 8/1978 | Martin et al. . | |
| 4,133,317 | 1/1979 | Briskin . | |
| 4,219,031 | 8/1980 | Rainer et al. . | |
| 4,225,636 | 9/1980 | Cline et al. . | |
| 4,231,377 | 11/1980 | Cline et al. . | |
| 4,244,381 | 1/1981 | Lendvay . | |
| 4,286,604 | 9/1981 | Ehretsmann et al. . | |
| 4,326,544 | 4/1982 | Hardwick et al. . | |
| 4,407,308 | 10/1983 | Baker et al. . | |
| 4,420,002 | 12/1983 | Cline . | |
| 4,433,697 | 2/1984 | Cline et al. . | |
| 4,450,847 | 5/1984 | Owens . | |
| 4,453,553 | 6/1984 | Cohn . | |
| 4,461,311 | 7/1984 | Mathews et al. . | |
| 4,481,958 | 11/1984 | Rainer et al. . | |
| 4,489,738 | 12/1984 | Simon . | |
| 4,561,454 | 12/1985 | Guess . | |
| 4,596,259 | 6/1986 | White et al. . | |
| 4,607,647 | 8/1986 | Dashley et al. | 131/365 |
| 4,624,268 | 11/1986 | Baker et al. . | |
| 4,637,410 | 1/1987 | Luke | 131/361 |
| 4,714,082 | 12/1987 | Banerjee et al. . | |
| 4,721,120 | 1/1988 | Greig et al. . | |

FOREIGN PATENT DOCUMENTS

| | | |
|---|---|---|
| 117355 | 9/1984 | European Pat. Off. . |
| 290911 | 11/1988 | European Pat. Off. . |

*Primary Examiner*—V. Millin

[57] ABSTRACT

Cigarettes which yield very low levels of sidestream "tar" during use comprise a paper wrapper having an air permeability of less than about 10 CORESTA units, and a blend of a tobacco filler material and a second smokable material. The second smokable material preferably includes about 60 weight percent calcium carbonate, about 30 weight percent pyrolyzed alpha-cellulose and about 10 weight percent carboxymethyl cellulose. Such cigarettes, when used, generate very low amounts of sidestream "tar," and hence, very low levels of visible sidestream smoke.

12 Claims, 1 Drawing Sheet

CIGARETTE

BACKGROUND OF THE INVENTION

The present invention relates to cigarettes which burn tobacco and in particular to cigarettes which, when smoked, generate low amounts of sidestream "tar" as well as sustain smolder during FTC smoking conditions.

Popular smoking articles such as cigarettes have a substantially cylindrical rod shaped structure and include a charge of smokable material such as shredded tobacco (e.g., cut filler) surrounded by a paper wrapper thereby forming a so-called "tobacco rod". It has become desirable to manufacture cigarettes having cylindrical filter elements aligned in an end-to-end relationship with the tobacco rod. Typically, filter elements are manufactured from fibrous materials such as cellulose acetate and plug wrap, and are attached to the tobacco rod using a circumscribing tipping material.

Cigarettes are employed by the user by lighting one end thereof and burning the tobacco rod. The user then receives mainstream smoke into his/her mouth by drawing on the opposite end (e.g., the filter end) of the cigarette. During the time that the cigarette is burning, sidestream smoke is generated. Sidestream smoke is smoke which directly enters the atmosphere from the lit end of the cigarette. Sidestream smoke diffuses into the atmosphere, and the characteristic visible nature thereof may be perceived negatively by certain individuals. The relative amount of visible sidestream smoke generated by a burning cigarette is related to the amount of sidestream "tar" generated by that burning cigarette. Typical cigarettes of about 84 mm length (e.g., having a tobacco rod length of about 57mm and a filter element length of about 27 mm) often yield about 25 to about 35 mg of sidestream "tar" per cigarette. See, Proctor et al, *Analyst*, vol. 113, p. 1509 (1988), for an apparatus and technique for determining the sidestream "tar" of a cigarette.

U.S. Pat. No. 4,637,410) to Luke proposes a cigarette having a circumference of from 10 mm to 19 mm. At col. 2, lines 5–7 of the reference, it is disclosed that the proposed cigarettes exhibit lower smoke component mainstream and sidestream deliveries.

U.S. Pat. No. 4,624,268 to Baker et al proposes a cigarette having wrapper paper with an inherent air permeability of 3 to 45 CORESTA units. For example, the wrapper paper is disclosed as having a coating of starch, aluminum oxide, magnesium oxide, calcium oxide, sodium formate and sodium acetate. See col. 3, lines 23–37.

U.S. Pat. No. 4,407,308 to Baker proposes a cigarette which reportedly (i) yields low sidestream smoke production upon use, and (ii) may be such as to self-extinguish when left to smolder for a prolonged period. Such a cigarette has a smokable tobacco material wrapped in a wrapper having an air permeability of not more than 3 CORESTA units.

U.S. Pat. No. 4,231,377 to Cline et al, U.S. Pat. No. 4,420,002 to Cline, and U.S. Pat. No. 4,450,847 to Owen; propose that cigarette paper wrappers containing magnesium oxide and/or magnesium hydroxide materials can be used in order to manufacture cigarettes which yield reduced visible sidestream smoke during static burn periods.

It would be desirable for the cigarette manufacturer to provide a good tasting cigarette which provides good smoking satisfaction, provides low mainstream gas phase deliveries, sustains smolder during FTC smoking conditions, and which generates low levels of sidestream "tar" and hence low levels of visible sidestream smoke.

SUMMARY OF THE INVENTION

The present invention relates to a cigarette which delivers good tobacco flavor, pleasure and satisfaction while generating relatively low levels of sidestream "tar".

Cigarettes of the present invention include a charge or roll of smokable material contained in a circumscribing outer wrapping material. The smokable material is a smokable filler material comprising (i) tobacco material, and (ii) a second smokable material which includes a carbonaceous material (e.g., pyrolyzed alpha-cellulose) and a binding agent (e.g., carboxymethyl cellulose), and preferably an inorganic material (e.g., calcium carbonate). The wrapping material, which surrounds the roll of smokable material to thereby form a so-called "tobacco rod", has a low air permeability. Wrapping materials having a low air permeability or low porosity typically exhibit a porosity below about 10 CORESTA units. A CORESTA unit is a measure of the linear air velocity which passes through a 1 $cm^2$ area of wrapper at a constant pressure of 1 centibar. See CORESTA Publication ISO/TC 126/SC I N159E (1986).

The cigarettes of the present invention contain an amount of the second filler material having a sufficiently high level of carbonaceous material to sustain smolder when such cigarettes are smoked under FTC smoking conditions. For example, a cigarette having an outer wrap having an air permeability of about 5 CORESTA units or less normally includes a sufficient amount of the second filler material such that the total smokable blend comprises about 9 percent or more, preferably about 11 percent or more, of carbonaceous material, based on the total weight of the blend.

The cigarettes of the present invention normally contain a second smokable material having an amount of inorganic material sufficient to provide (i) an acceptable ash and fire cone, (ii) a cigarette having a weight which is not overly excessive, and (iii) a cigarette having a burn rate which is acceptable.

Preferred cigarettes of the present invention include a filter element which acts as a mouthpiece. Such cigarettes can be air diluted (e.g., by perforating the tipping material in the region which overlies the filter elements or by other such air dilution means). Normally, preferred cigarettes employ moderate to low efficiency filter elements, and the filter element is ventilated to provide a cigarette having an air dilution between about 25 and about 75 percent. As used herein, a low filtration efficiency is a filtration efficiency of less than about 40. See, Keith in Schemeltz's *The Chemistry of Tobacco and Tobacco Smoke*, p. 157 (1972). As used herein, the term "air dilution" is the ratio (expressed as a percentage) of the volume of air drawn through the air dilution means to the total volume of air and smoke drawn through the cigarette and exiting the extreme mouthend portion of the cigarette. See, Selke et al, *Beitr. Zur Tabak. In.*, Vol. 4, p. 193 (1978).

DETAILED DESCRIPTION OF THE PREFERRED EMBODIMENTS

Figure 1:
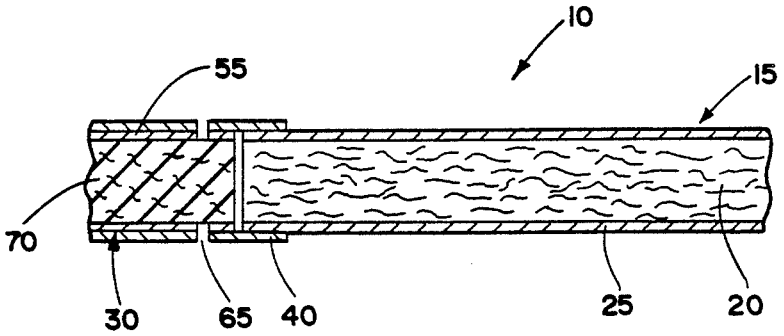
FIG. 1 is a longitudinal sectional view of a cigarette of this invention.

A preferred embodiment of a cigarette this invention is shown in FIG. 1. The cigarette 10, includes a generally cylindrical rod 15 of smokable material 20, such as cut filler, contained in circumscribing outer wrapping material 25. The rod 15 is hereinafter referred to as a "tobacco rod". The ends of the tobacco rod 15 are open to expose the smokable material. The cigarette 10 also includes a filter element 30 positioned adjacent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough.

The smokable material 20 employed in the manufacture of the tobacco rod can vary. For example, the smokable material of the cigarette can have the form of filler (e.g., such as tobacco cut filler). As used herein, the terms "filler" or "cut filler" are meant to include tobacco materials and other smokable materials which have a form suitable for use in the manufacture of tobacco rods for cigarettes. As such, filler can include smokable materials which are blended and are in a form ready for cigarette manufacture. The filler materials normally are employed in the form of strands or shreds as is common in conventional cigarette manufacture. For example, the tobacco cut filler material can be employed in the form of strands or shreds from sheet-like or "strip" materials which are cut into widths ranging from about 1/25 inch to about 1/60 inch, preferably from about 1/30 inch to about 1/40 inch. Generally, such strands or shreds have lengths which range from about 0.25 inch to about 3 inches.

Examples of suitable tobacco materials include flue-cured, Burley, Maryland or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof.

The tobacco material is blended with a second smokable material. The second smokable material normally includes an inorganic material such as finely divided calcium carbonate, calcium sulfate, magnesium oxide, magnesium hydroxide, attapulgite clays, bentonite clays, or the like. Preferably, the inorganic material is a material which does not burn or change state to any significant degree at those conditions experienced during use of the cigarette. As such, the inorganic material does not tend to provide, to any substantial degree, an undesirable off-taste to the mainstream cigarette smoke during use of the cigarette. The second smokable material also includes a carbonaceous material such as a carbonized or pyrolyzed material derived from an organic material having a high alpha-cellulose content (i.e., an alpha-cellulose content greater than about 80 weight percent). An example of an organic material having a high alpha-cellulose content is cotton linters. For purposes of this invention, the term "carbonaceous" means consisting primarily of carbon. Preferred carbonaceous materials include about 80 weight percent carbon or more. The second smokable material also includes a binding agent such as a polysaccharide binder. Typically, the second smokable material is provided by forming a slurry of the components, casting the slurry as a sheet, and drying the cast material to form a relatively dry sheet. Alternatively, a smokable material having a tobacco character is provided by forming a slurry of the components with a tobacco material such as tobacco dust or a tobacco extract, casting the slurry as a sheet, and drying the cast material to form a relatively dry sheet. The sheet can be cut or broken into "strip" form, and can be later cut or shredded into cut filler form. Flavors such as menthol can be incorporated into the smokable material by adding the flavor to the slurry during the manufacture of the smokable material, if desired.

Preferred smokable blends comprise from about 10 to about 90, more preferably from about 20 to about 80, more preferably from about 40 to about 70 weight percent tobacco filler material; and about from 10 to about 90, more preferably from about 20 to about 80, most preferably about 30 to about 60 weight percent of a second filler material. The second filler material normally includes about 0 to about 80, preferably about 20 to about 70 weight percent inorganic material; about 10 to about 95, preferably about 25 to about 70 weight percent carbonaceous material; and up to about 15, preferably between about 5 to about 15 weight percent binding agent.

Preferred cigarettes of this invention contain a sufficient amount of the second filler material which in turn includes a sufficient amount of carbonaceous material such that the total smokable blend comprises about 9 percent or more, more preferably about 11 percent or more, of carbonaceous material, based on the total weight of the blend. Cigarettes having low porosity paper outer wrappers and having very low levels or absent of carbonaceous material can have the propensity to not sustain smolder, and hence self-extinguish, when smoked under FTC smoking conditions.

The composition of the second filler material can govern the quality and appearance of the ash and fire cone of the cigarette during use. In particular, for smokable blends of the tobacco and second filler materials which have more than about 30 weight percent second filler materials, it is desirable that the second filler material comprise a sufficiently high amount of inorganic material to provide a cigarette having an ash and fire cone which is not overly cohesive. As such, preferred smokable blends having relatively high amounts of the second filler material normally include sufficient inorganic material to provide a cigarette having an ash and fire cone which resembles and behaves as the ash and fire cone of a cigarette having all tobacco smokable filler material. However, the amount of inorganic material within the second filler material, and the amount of second filler material present within the cigarette is such that (i) the cigarette weight is not excessive (i.e., due to the high level of inorganic material), and (ii) the cigarette achieves a burn rate which is acceptable.

Smokable materials (e.g., either or both of the tobacco and second filler materials) can be cased and top dressed as is conventionally performed during various stages of cigarette manufacture. For example, blend components such as flavoring agents and humectants can be applied to the smokable material as is commonly done when cigarettes are manufactured. Suitable flavoring agents include vanillin, tobacco extracts such as tobacco essences and tobacco aroma oils, cocoa, licorice, menthol, and the like. Flavor modifying agents such as levulinic acid can be applied to the smokable material (e.g., in amounts ranging from about 0.01 to about 2 percent, normally from about 0.1 to about 1 percent, preferably about 0.2 to about 0.6 percent, based on the dry weight of the smokable material). Such components conveniently are applied to the smokable material as casing and top dressing components.

Typically, the tobacco rod 15 has a length which ranges from about 35 mm to about 85 nm, preferably about 40 to about 70 mm; and a circumference of about 17 mm to about 27 mm, preferably about 22.5 mm to about 25 mm. Short cigarette rods (i.e., having lengths from about 35 to about 50 mm) can be employed, particularly when smokable blends having a relatively high packing density are employed.

The wrapping material 25 is a cigarette wrapping material having a low air permeability value. For example, such wrapping materials have air permeabilities of less than about 10 CORESTA units, sometimes less than about 5 CORESTA, often less than about 3 CORESTA units, and frequently less than about 1 CORESTA unit. Typical wrapping materials are cigarette wrapping papers having air permeabilities of less than about 10 CORESTA units. A suitable wrapping material is a cigarette paper consisting essentially of calcium carbonate and flax which is available as Reference No. TOD 03816 from Ecusta Corp. Also suitable are cigarette papers manufactured from wood pulp and inorganic fillers such as calcium carbonate. Particularly preferred are cigarette paper wrappers which include an amount of a polymeric film forming agent sufficient to provide a paper having the desirably low air permeability value. For example, a sufficient amount of an aqueous solution of a polymeric film forming agent can be applied to a paper wrapper having an air permeability of from about 10 to about 30 CORESTA units to provide a paper having an air permeability of less than about 10 CORESTA units, sometimes less than about 5 CORESTA units, often less than about 3 CORESTA units, and frequently less than about 1 CORESTA unit. Similarly, a sufficient amount of an aqueous solution of a polymeric film forming agent can be applied to a paper wrapper having a relatively low air permeability (e.g., less than about 10 CORESTA units) to provide a paper having yet a lower air permeability (e.g., less than about 5 CORESTA units, and frequently less than about 1 CORESTA unit).

The polymeric film forming agent can be applied to the paper wrapper during the manufacture of the paper, or applied as a print or paint after manufacture of the paper is complete. Typically, the film forming agent is applied to the paper as a dilute solution (e.g., at a concentration of about 0.2 to about 5 weight percent relative to the solvent) for ease of processing. The amount of film forming agent applied to the paper wrapper depends upon factors such as the permeability of the paper and the film forming capabilities of the film forming agent. Typically, the amount of film forming agent employed ranges from about 1 to about 10 percent, based on the dry weight of the paper. Examples of polymeric film forming agents are carboxy methyl cellulose, ethyl cellulose, xanthan gum, arabic gum, guar gum, propylene glycol alginate, starches and the like. Mixtures of polymeric materials, such as a mixture of guar, xanthan and locust bean gums available as GFS from Kelco Corp., also can be employed.

The tobacco rods and the resulting cigarettes can be manufactured in any known configuration using known cigarette making techniques and equipment. Highly preferred cigarette rods include a smokable blend wrapped in a single layer of wrapping material.

The packing densities of the blend of smokable materials contained within the outer wrapping material can vary. Typical packing densities for tobacco rods of cigarettes of this invention range from about 150 to about 300 mg/cm$^3$. Normally, packing densities of the tobacco rods range from about 200 to about 280 mg/cm$^3$, frequently about 250 to about 275 mg/cm$^3$, particularly when relatively short (i.e., less than 50 mm long) tobacco rods are employed.

The filter element 30 normally is attached to the tobacco rod 15 by tipping material 40 which circumscribes both the entire length of the filter element and an adjacent region of the tobacco rod. The inner surface of the tipping material 40 is fixedly secured to the outer surface of the plug wrap 55 and the outer surface of the wrapping material 25 of the tobacco rod, using a suitable adhesive. A ventilated or air diluted cigarette is provided with an air dilution means such as a series of perforations 65 which extend through the tipping material and plug wrap.

Typically, the filter element 30 has a length which ranges from about 15 mm to about 35 mm, preferably about 25 mm to about 30; and a circumference of about 17 mm to about 27 mm, preferably about 22 mm to about 25 mm. Filter material 70 normally is provided from fibrous materials such as cellulose acetate or polyprolyene tow. The plug wrap 55 typically is a conventional paper plug wrap, and can be either air permeable or essentially air impermeable. However, if desired, nonwrapped cellulose acetate filter elements can be employed to provide the various segments. The various filter element segments suitable for use in this invention can be manufactured using known cigarette filter making techniques and equipment.

Preferred filter elements provide minimal mainstream smoke removal efficiencies while maintaining the desirable draw characteristics of the cigarette. Such minimal smoke removal efficiencies are provided by the so-called "low efficiency" filter elements. Low efficiency filter elements have a minimal ability to remove mainstream smoke particulates. Generally, low efficiency filter elements provide less than about 40 weight percent mainstream smoke particulate removal efficiency. The low efficiency filter element is desirably used herein in order that the relatively low "tar" yield is obtained primarily as a result of a relatively high level of filter ventilation or air dilution. Such cigarette configurations provide a means for reducing the yields of mainstream gaseous components.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

For air diluted or ventilated cigarettes of this invention, the amount of air dilution can vary. Preferably, the amount of air dilution for a cigarette is greater than about 25 percent, more preferably greater than about 40 percent. The upper limit of air dilution for a cigarette typically is less than about 75 percent, more frequently less than about 65 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

Cigarettes of the present invention, when smoked, generally yield less than about 20 mg, preferably less than about 10 mg of sidestream "tar" per cigarette, as determined using the apparatus and techniques described by Proctor et al, *Analyst*, Vol. 113, p. 1509 (1988). Such cigarettes normally provide more than about 5 puffs, preferably more than about 6 puffs per cigarette when smoked under FTC conditions. (FTC conditions consist of 35 ml puffs of 2 second duration, taken every 60 seconds.) Normally, cigarettes of the present invention provide less than about 12 puffs, and often less than about 10 puffs, when smoked under FTC conditions.

Mainstream gas phase yields for cigarettes of the present invention often are reduced (generally in proportion to the amount of second filler material employed) for many mainstream gas phase components as compared to cigarettes having smokable blends comprising essentially all tobacco filler material. For cigarettes of this invention which are smoked under FTC conditions, FTC carbon monoxide yields normally are less than about 20 mg, often less than about 15 mg, and frequently less than about 12 mg, per cigarette.

The following examples are provided in order to further illustrate the invention but should not be construed as limiting the scope thereof. Unless otherwise noted, all parts and percentages are by weight.

EXAMPLE 1

Cigarettes substantially as shown in FIG. 1 are prepared as follows:

The cigarettes each have a length of 84 mm and a circumference of 24.8 mm, and include a tobacco rod having a length of 57 mm and a filter element having a length of 27 mm. Each filter element includes cellulose acetate tow circumscribed by nonporous paper plug wrap. Each filter element is attached to each tobacco rod using nonporous tipping paper. For each cigarette, the tipping paper circumscribes the filter element and a 4 mm length of the tobacco rod in the region adjacent the filter element. The filter elements are not ventilated.

The smokable blend includes 70 parts tobacco material and 30 parts of a second smokable material. The tobacco material has the form of a so-called "American blend", and includes flue-cured, Burley and Oriental tobaccos as well as reconstituted tobacco from a papermaking process and volume expanded flue-cured and Burley tobaccos. The second smokable material consists essentially of carboxymethyl cellulose, pyrolyzed cotton linters and calcium carbonate. (The second smokable material is described in greater detail hereinafter.) The blend of tobacco materials is cased separately from the second filler materials using a mixture of glycerin, water and flavors. The blend is in the form of strands or shreds but at 32 cuts per inch (i.e., in cut filler form) and is equilibrated to a moisture level of about 12.5 percent.

The second smokable material is provided as follows: Cotton linters (i.e., a non-tobacco material) having an alpha-cellulose content greater than 90 percent are heated in a closed oven under nitrogen atmosphere. After about 2.5 hours of heating, the temperature within the oven reaches 1225° F. The temperature within the oven is held at 1225° F. for about 1 hour under nitrogen atmosphere. Then, the heating is ceased, and the temperature within the oven cools to ambient temperature in about 4 hours. The heated (pyrolyzed) cotton linters are black in color and have undergone a weight loss of about 80 percent. Sodium carboxymethyl cellulose available as Aqualon Cellulose Gum from Aqualon Co. and water are mixed in a high shear mixer to produce a viscous liquid. The pyrolyzed cotton linters are folded into the viscous liquid, and then finely divided calcium carbonate is folded into the resulting mixture. The calcium carbonate is available as No. 3050 White Calcium Carbonate from Georgia Marble Co. The resulting mixture is a thick slurry having a solid (i.e., carboxymethyl cellulose, pyrolyzed cotton linters and calcium carbonate) content of about 15 percent. The slurry is cast onto a stainless steel sheet and heated to 220° F. to remove moisture. The resulting material is a black sheet having a thickness of about 0.43 mm, a density of about 19.9 g/cm$^3$, and a moisture content of about 15 percent. The sheet has 10 parts carboxymethyl cellulose, 60 parts calcium carbonate and 30 parts pyrolyzed cotton linters. The sheet is cut into strip form, about 2 inches by 3 inches in size. The strips are shredded at 32 cuts per inch and mixed with similarly shredded cased tobacco materials to form a smokable blend.

The cigarette paper wrap is a flax fiber/calcium carbonate paper available as Reference No. TOD 03816 from Ecusta Corp. The paper wrap exhibits an air permeability of about 5 CORESTA units.

Cigarettes are made using a cigarette maker available as a Pilot Maker from Hauni-Werke Korber & Co. K.G. In particular, the smokable material is circumscribed by a single layer of paper wrap. The packing density of the smokable material within each cigarette rod is 0.21 g/cm$^3$.

The cigarettes are employed by burning the tobacco rod such that the blend of smokable material within the paper wrapper burns to yield smoke. When employed, such cigarettes yield very low levels of visible sidestream smoke.

Cigarettes are smoked under FTC smoking conditions and using the following apparatus and technique for measuring sidestream "tar": The cigarettes are smoked under a glass chimney. Air flow is regulated through the chimney at 2 l/min using a vacuum pump such that the sidestream particulate matter is provided with the propensity to collect on a Cambridge filter pad positioned at the top of the chimney. After smoking is completed, the Cambridge pad is removed, and the amount of "filter pad particulate matter" is determined from the weight gain of the Cambridge filter pad. The "filter pad tar" is the "filter pad particulate matter" minus the water and nicotine determined by analysis of the filter pad. The inner portion of the chimney is washed with isopropanol to collect "chimney tar"

which collects on the inner walls of the chimney during the time that the cigarette is smoked. The amount of "chimney tar" is determined by UV analysis. The sidestream "tar" of the cigarette is determined by adding the amount of "filter pad tar" with the amount of "chimney tar." See. Proctor et al, *Analyst*, Vol. 113, p. 1509 (1988) for a detailed description of the apparatus and technique for measuring sidestream "tar".

Cigarettes smoked and tested in this manner yield 7.3 puffs and 14.6 mg sidestream "tar," per cigarette. The cigarettes do not self-extinguish during the smolder period experienced during FTC smoking conditions.

For comparison purposes, an 84 mm cigarette having a tobacco rod of 57 mm length, a filter element of 27 mm length and a circumference of 24.8 mm is provided. The cigarette is air diluted to about 30 percent by laser perforations encircling the filter element and tipping about 13 mm from the extreme mouthend of the cigarette. The smokable blend is 100 percent of the cased tobacco material blend employed to provide the previously described cigarette of this Example. The cigarette paper is available as Reference No. 719 from Ecusta Corp., and exhibits an air permeability of 29 CORESTA units. The packing density of the tobacco blend within the tobacco rod is about 0.23 g/cm$^3$. The comparison cigarette is smoked under FTC smoking conditions using the previously described apparatus and technique for measuring sidestream "tar." The comparison cigarette yields more visible sidestream smoke than the previously described cigarette of this example. The comparison cigarette yields 7.9 puffs and 25.5 mg sidestream "tar."

EXAMPLE 2

Cigarettes having a total length of 69 mm and a circumference of 24.8 mm are prepared as follows:

The cigarettes include a tobacco rod of 44 mm length and a paperboard tube (i.e., mouthpiece) positioned at one end thereof. The paperboard tube has the same diameter as the tobacco rod, and the rod and tube are connected together using adhesive tape which acts as a tipping material. The tape circumscribes about 4 mm of the tobacco rod.

The cigarette blend includes 50 parts tobacco material and 50 parts of a second smokable material. The tobacco material has the form of a so-called "American blend." The second smokable material consists essentially of carboxymethyl cellulose, pyrolyzed cotton linters and magnesium hydroxide. (The second smokable material is described in greater detail hereinafter.) The blend of tobacco materials is cased separated from the second smokable material using a mixture of glycerin, water and flavors. The blend is in the form of strand or shreds cut at 32 cuts per inch and is equilibrated to a moisture level of about 12.5 percent.

The second smokable material is provided as follows:

Cotton linters are pyrolyzed as described in Example 1, and mixed with a viscous sodium carboxymethyl cellulose solution in water, as described in Example 1. Into the cotton linter and carboxymethyl cellulose mixture is folded finely divided magnesium hydroxide available as USP/FCC Grade from Fisher Scientific Co. The resulting mixture is a thick slurry having a solid (i.e., carboxymethyl cellulose, pyrolyzed cotton linters and magnesium hydroxide) content of about 15 percent. The slurry is cast onto a flat surface and dried at ambient conditions. The resulting material is a black sheet. The sheet has 10 parts carboxymethyl cellulose, 65 parts pyrolyzed cotton linters and 25 parts magnesium hydroxide. The sheet is cut into strip form, about 2 inches by 3 inches in size. The strips are shredded at 32 cuts per inch and mixed with similarly shredded cased tobacco materials to form a smokable blend.

The cigarette paper wrap is a flax fiber/calcium carbonate paper available as Reference No. TOD 03816 from Ecusta Corp. The paper wrap exhibits an air permeability of about 5 CORESTA units.

Cigarette rods are made using a Pilot Maker from Hauni-Werke Korber & Co. K.G. The packing density of the smokable material within each cigarette rod is 0.27 g/cm$^3$. The mouthend paperboard tube is attached to one end of each tobacco rod by hand.

Cigarettes are smoked as described in Example 1. In particular, the tobacco rod is burned and a 37 mm length of the rod is smoked. The cigarettes yield very low levels of visible sidestream smoke. The cigarettes each yield 7.1 puffs and 8.0 mg of sidestream "tar." The cigarettes do not self-extinguish during the smolder period experienced during FTC smoking conditions.

EXAMPLE 3

Cigarettes as described in Example 2 are provided, except that the paper wrapper is treated with an aqueous solution of carboxymethyl cellulose. The solution is 0.5 parts sodium carboxymethyl cellulose available as 7HF from Aqualon Co. and 99.5 parts water. The solution is painted onto the exterior surface of the cigarette paper wrapper, and dried under ambient conditions. Sufficient solution is applied to the cigarette paper wrapper to provide that wrapper with essentially no air permeability (i.e., such that the wrapper exhibits an air permeability of 0 CORESTA units).

The cigarettes are smoked as described in Example 2, and yield very low levels of visible sidestream smoke. In particular, the sidestream smoke of each cigarette is essentially invisible during the static burn period during smoking. The cigarettes each yield 8.1 puffs and 5.8 mg of sidestream "tar." The cigarettes do not self-extinguish during the smolder period experienced during FTC smoking conditions.

For comparison purposes, a similar cigarette is provided, except that the smokable blend is 100 parts of the "American blend" previously employed as part of the smokable blend and absent of the second smokable material. Such a cigarette self-extinguishes during the smolder period experienced during FTC smoking conditions.

What is claimed is:

1. A cigarette having smokable material contained in a circumscribing outer wrapping material, the cigarette having:

(a) smokable filler material comprising: (i) from about 10 to about 90 weight percent tobacco filler material, and (ii) about 10 to about 90 weight percent of a second smokable material having from about 0 to up to about 90 weight percent inorganic material, from about 10 to about 95 weight percent carbonaceous material which includes pyrolyzed alpha-cellulose, and up to about 15 weight percent binding agent; the amount of carbonaceous material within the blend of smokable material being about 9 percent or more, based on the total weight of the blend; and (b) wrapping material circumscribing the smokable filler and having an air permeability of less than about 10 CORESTA units.

2. The cigarette of claim 1 wherein the wrapping material includes a polymeric film.

3. The cigarette of claim 1 wherein the smokable material contained in the wrapping material has a substantially cylindrical rod shaped structure having a circumference of about 17 mm to about 27 mm and a length of about 35 mm to about 50 mm.

4. The cigarette of claim 1, 2 or 3 wherein the packing density of the smokable material contained within the wrapping material ranges from about 200 to about 280 $mg/cm^3$.

5. The cigarette of claim 1 or 3 wherein the packing density of the smokable material contained within the wrapping material ranges from about 250 to about 275 $mg/cm^3$.

6. The cigarette of claim 1 wherein the inorganic material of the second smokable material includes a calcium carbonate.

7. The cigarette of claim 1, 2, 3 or 6 wherein the wrapping material has an air permeability of less than about 1 CORESTA unit.

8. The cigarette of claim 4 wherein the wrapping material has an air permeability of less than about 1 CORESTA unit.

9. The cigarette of claim 1 wherein the wrapping material has an air permeability of about 0 CORESTA unit.

10. The cigarette of claim 9 wherein the wrapping material includes a polymeric film.

11. The cigarette of claim 1 wherein the second smokable material includes from about 20 to about 70 weight percent inorganic material, about 25 to about 70 weight percent carbonaceous material, and about 5 to about 15 weight percent binding agent.

12. The cigarette of claim 11 wherein the inorganic material of the second smokable material includes calcium carbonate.

* * * * *